US006948961B2

(12) United States Patent
Oguchi

(10) Patent No.: US 6,948,961 B2
(45) Date of Patent: Sep. 27, 2005

(54) CARD CONNECTOR INCLUDING EJECTING LEVER FOR EJECTING CARD

(75) Inventor: Wataru Oguchi, Miyagi-ken (JP)

(73) Assignee: ALPS Electric Co., Ltd., Tokyo (JP)

( * ) Notice: Subject to any disclaimer, the term of this patent is extended or adjusted under 35 U.S.C. 154(b) by 125 days.

(21) Appl. No.: 10/813,320

(22) Filed: Mar. 29, 2004

(65) Prior Publication Data

US 2004/0224545 A1 Nov. 11, 2004

(30) Foreign Application Priority Data

May 8, 2003 (JP) ..... 2003-130362

(51) Int. Cl.[7] ..... H01R 13/62
(52) U.S. Cl. ..... 439/160; 439/372; 439/310; 439/341
(58) Field of Search ..... 439/155–160, 439/372, 341–342, 310

(56) References Cited

U.S. PATENT DOCUMENTS 5,108,298 A * 4/1992 Simmel ..... 439/157
5,730,610 A * 3/1998 Hsia et al. ..... 439/160
RE35,938 E * 10/1998 O'Brien et al. ..... 439/160
6,089,889 A * 7/2000 Chiou et al. ..... 439/159
6,113,403 A * 9/2000 Oguchi ..... 439/159
6,174,181 B1 1/2001 Lai
6,361,339 B1 * 3/2002 Zhang et al. ..... 439/160
6,503,093 B1 * 1/2003 Sakata et al. ..... 439/328

FOREIGN PATENT DOCUMENTS

JP 9-82411 3/1997

* cited by examiner

*Primary Examiner*—Truc Nguyen
(74) *Attorney, Agent, or Firm*—Beyer Weaver & Thomas LLP.

(57) ABSTRACT

A card connector includes a rotatable ejecting lever having a first end and a second end and supported by a fixed journal, the second end moving in the direction of ejecting a card to eject the card when the first end is pushed in the direction of inserting the card; and distance varying means increasing the distance from the journal to the contact point between the ejecting lever and the card during ejection of the card.

10 Claims, 8 Drawing Sheets

CARD CONNECTOR INCLUDING EJECTING LEVER FOR EJECTING CARD

BACKGROUND OF THE INVENTION

1. Field of the Invention

The present invention relates to a card connector for a card such as a small size memory card having an information storage function, the connector having an ejecting lever for ejecting the card in place.

2. Description of the Related Art

There is known a card connector in which an ejecting lever is supported rotatably and a push rod is connected to the ejecting lever. In this card connector, the push rod is pushed to turn the ejecting lever. The card in place is pushed out by the ejecting lever in the direction of ejecting.

In this type of card connector, in the starting stage of card ejection, that is to say, when the card in place starts to be ejected, it is necessary to give the ejecting lever the pushing force to overcome the great connecting force between a contact of the card used for signal processing and a terminal of the card connector. Therefore, in the starting stage of card ejection, it is desirable to push out the card with a comparatively great force. After the contact of the card is released from the terminal of the card connector, it is desirable that the card moves through a comparatively great distance.

To meet this requirement, for example, Japanese Unexamined Patent Application Publication No. 9-82411 discloses a card connector in which the position of the fulcrum of an arm bar, that is to say, an ejecting lever is variable. This card connector uses a first fulcrum in the ejection starting stage in which the card is released from the terminal. The distance between the first fulcrum and the card pushing portion is small. After the card is released from the terminal, this card connector uses a second fulcrum. The distance between the second fulcrum and the card pushing portion is great.

In this card connector, when the card is released from the terminal, that is to say, when the ejecting lever starts to be turned to push out the card, it is possible to give the ejecting lever a comparatively great force to push the card because the distance between the fulcrum and the card pushing portion is small. Therefore, the card starts to be ejected smoothly. After the card is released from the terminal, although the force of the ejecting lever pushing the card becomes smaller than that in the starting stage of card ejection, the ejected distance becomes great because the distance between the fulcrum and the card pushing portion becomes great. Therefore, the card is ejected quickly.

In order to obtain great force pushing the card in the ejection starting stage, and to obtain great ejected distance of the card after the card is released from the terminal, the card connector described above has the structure in which the position of the fulcrum is shifted during the turning of the ejecting lever. That is to say, in this card connector, the ejecting lever is turned around a plurality of fulcrums. Therefore, turning of the ejecting lever tends to be unstable and the ejecting performance tends to be degraded. There is concern that the reliability of the card connector is thereby lowered.

SUMMARY OF THE INVENTION

Considering the above-described situation, it is an object of the present invention to provide a card connector in which an ejecting lever turns stably as well as pushes out a card with a comparatively great force in the starting stage of card ejection and then ejects the card through a comparatively great ejected distance.

In accordance with the present invention, there is provided a card connector including a rotatable ejecting lever having a first end and a second end and journaled at a fixed fulcrum, the second end moving in the direction of ejecting a card to push out the card when the first end is pushed in the direction of inserting the card; and a distance varying unit increasing the distance from the fulcrum to the contact point between the ejecting lever and the card during ejection of the card.

In the starting stage of card ejection, the distance from the fulcrum to the contact point between the ejecting lever and the card is comparatively small. Therefore, by turning the ejecting lever, it is possible to apply a comparatively great force to the card so as to push out the card. After that, the distance from the fulcrum to the contact point between the ejecting lever and the card is increased by the distance varying unit. Therefore, the ejected distance of the card ejected with the turning of the ejecting lever becomes great so that the card can be ejected quickly. In addition, the position of the fulcrum of the ejecting lever is fixed. Therefore, the ejecting lever turns around only a single fulcrum during ejection of the card. Thus, the stability of turning of the ejecting lever is achieved.

The ejecting lever may be disposed in the back of the connector.

The portion in the back of the connector is provided with a terminal. It is possible to make use of the portion for disposing the ejecting lever.

The fulcrum may be a journal integrated with a header having a terminal coming into contact with a contact of the card used for signal processing.

In this case, the journal of the ejecting lever can be formed at the same time as the header.

The fulcrum may be a journal integrated with a cover covering a housing forming a main body.

In this case, the journal of the ejecting lever can be formed at the same time as the cover.

The distance varying unit may include a first pushing portion and a second pushing portion disposed at the second end of the ejecting lever, the first pushing portion pushing the card in the starting stage of card ejection, the second pushing portion being farther than the first pushing portion from the fulcrum and pushing the card after the starting stage of card ejection.

The first pushing portion of the ejecting lever pushes the card in the starting stage of card ejection, and then the second pushing portion of the ejecting lever pushes the card. While the distance between the first pushing portion and the fulcrum is comparatively small, the distance between the second pushing portion and the fulcrum is great. Therefore, in the starting stage of card ejection, by using the first pushing portion which is a small distance from the fulcrum, it is possible to apply a comparatively great force to the card so as to push out the card. Then, by using the second pushing portion which is a great distance from the fulcrum, it is possible to increase the ejected distance of the card so as to eject the card quickly.

The distance varying unit may include a curved portion disposed at the second end of the ejecting lever, the curved portion pushing the card and being convex toward the front end of the card, the front end of the card being in the back of the connector when the card is in place.

With respect to the convex curved portion of the ejecting lever, a predetermined segment that is a small distance from the fulcrum serves as a contact point with the card in the ejection starting stage, and another predetermined segment that is a great distance from the fulcrum serves as another contact point with the card after that.

In the starting stage of card ejection, the nearer segment of the curved portion pushes the card. After that, the farther segment of the curved portion pushes the card. According to the convexity of the curved portion, the farther segment of the curved portion is displaced away from the fulcrum continuously with the turning of the ejecting lever. That is to say, the farther segment moves with the turning of the ejecting lever along the front end of the card. Thus, in the ejection starting stage, the distance from the fulcrum to the nearer segment of the curved portion is small. After that, the distance from the fulcrum to the farther segment of the curved portion increases gradually.

Therefore, in the starting stage of card ejection, it is possible to apply a comparatively great force to the card via the nearer segment of the curved portion so as to push out the card. After that, it is possible to increase the ejected distance of the card continuously via the farther segment of the curved portion so as to push out the card quickly. Thus, smooth ejection of the card is achieved.

The card may have a recess accommodating at least part of the second end of the ejecting lever, the recess being at the front end of the card in the back of the connector when the card is in place, and the ejecting lever may be disposed so that the second end pushes the wall of the recess when the card is ejected.

In this case, at least part of the second end of the ejecting lever is accommodated by the recess formed in the card. Therefore, the card connector can be downsized with respect to the depth.

The card may have an upper wall covering the recess.

Since the upper wall restricts the vertical movement of the ejecting lever, smooth turning of the ejecting lever is achieved. In addition, since the ejecting lever is not located on the upper surface of the card, the upper surface of the card is protected from being scraped by the ejecting lever.

The ejecting lever may be disposed such that the second end of the ejecting lever pushes the front end of the card when the card is ejected, the card being in the back of the connector when the card is in place.

In this case, with turning of the ejecting lever, the second end of the ejecting lever pushes the front end of the card so as to eject the card.

The card connector may further include a push rod pushing the first end of the ejecting lever in the direction of inserting the card.

By pushing the push rod, the first end of the ejecting lever moves and the ejecting lever turns around the fulcrum. Thus a predetermined card ejecting operation is achieved.

DESCRIPTION OF THE PREFERRED EMBODIMENTS

The embodiments of the present invention will now be described with reference to the drawings.

Figure 1:
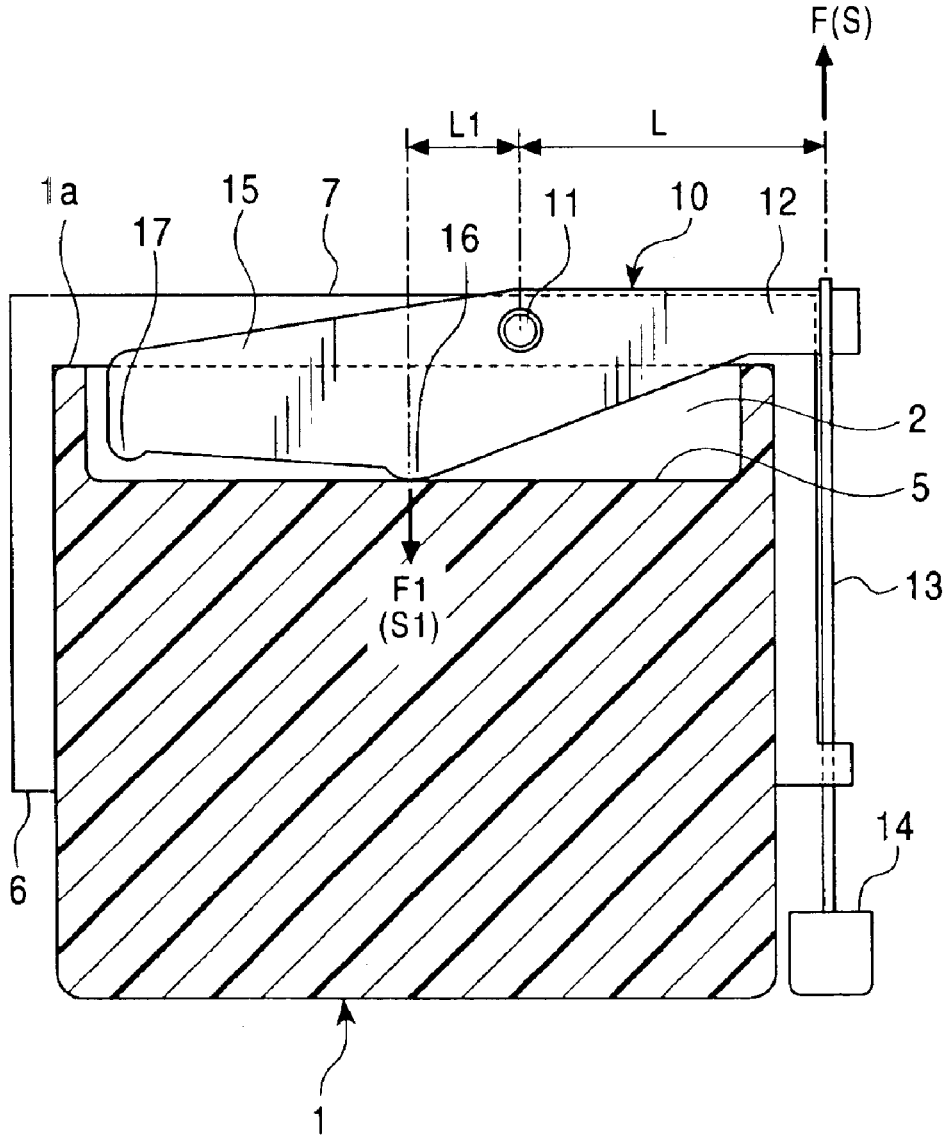
FIG. 1 is a plan view showing a card connector in the starting stage of card ejection according to a first embodiment of the present invention, including a sectional view of a card.
Figure 2:
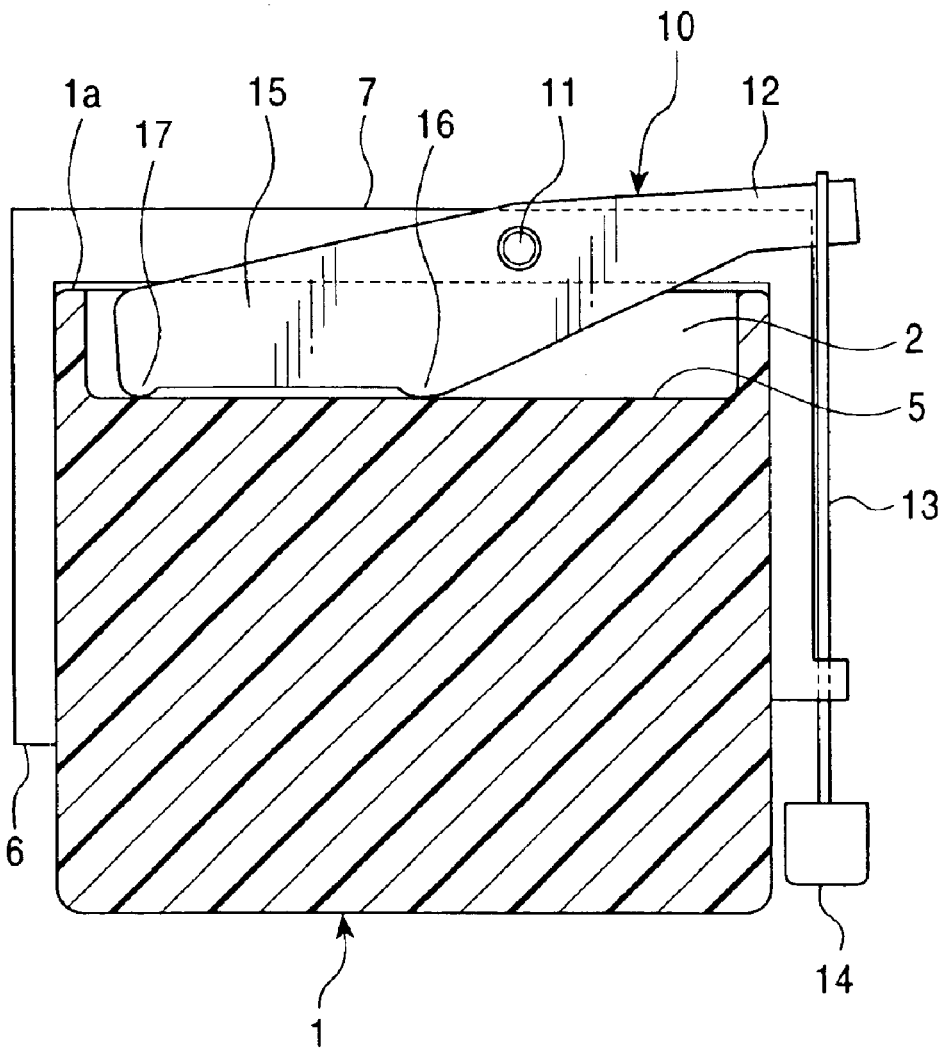
FIG. 2 is a plan view showing the card connector in the middle stage of card ejection according to the first embodiment of the present invention, including a sectional view of the card.
Figure 3:
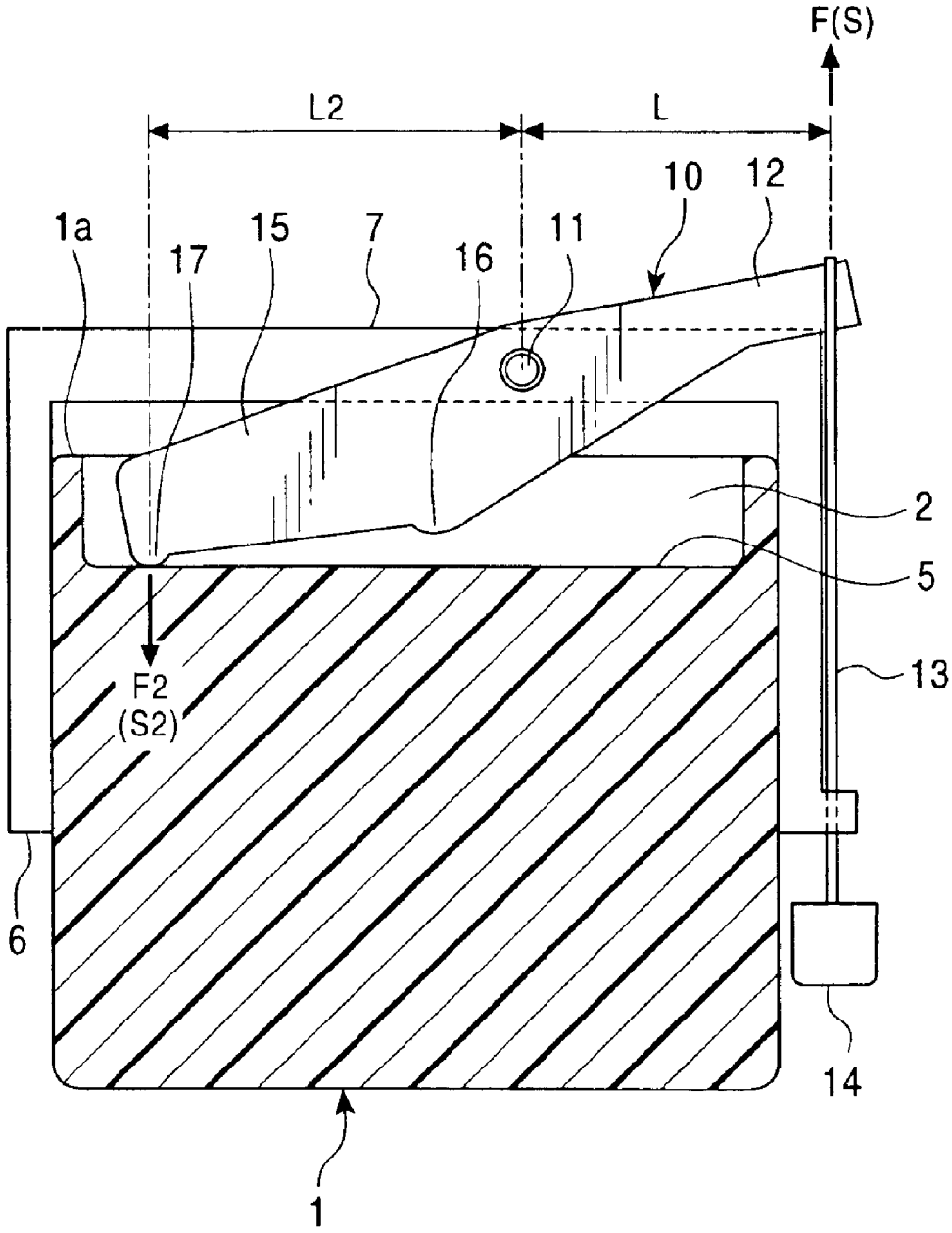
FIG. 3 is a plan view showing the card connector in the ending stage of card ejection according to the first embodiment of the present invention, including a sectional view of the card.

FIGS. 1 to 3 are illustrations of a first embodiment of the present invention, including sectional views of a card. FIG. 1 is a plan view showing the starting stage of card ejection. FIG. 2 is a plan view showing the middle stage of card ejection. FIG. 3 is a plan view showing the ending stage of card ejection.

Figure 4A:
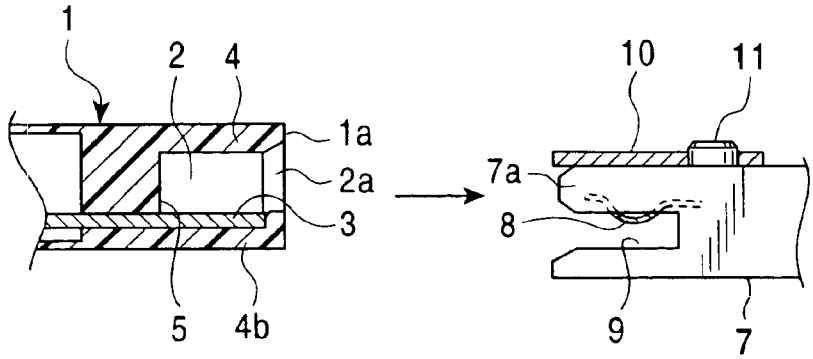
FIGS. 4A and 4B show the relation among the card, the ejecting lever, and the header included in the first embodiment of the present invention, FIG. 4A being a cross-sectional view showing the relevant part before the card is placed, FIG. 4B being a cross-sectional view showing the relevant part when the card is placed.
Figure 4B:
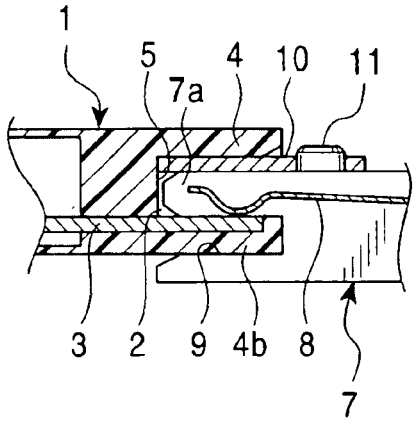

FIGS. 4A and 4B show the relation among the card, an ejecting lever, and a header included in the first embodiment of the present invention. FIG. 4A is a cross-sectional view showing the relevant part before the card is placed. FIG. 4B is a cross-sectional view showing the relevant part when the card is placed.

[The Card Used in the First Embodiment]

The card 1 used in the first embodiment of the present invention is a small size memory card having an information storage function. As shown in FIG. 1, the card 1 has a recess 2 at the front end 1*a* located in the back of the connector when the card 1 is in place. As shown in FIG. 4A, the recess 2 has an opening 2*a*, and the upper part of the recess 2 is covered by the upper wall 4. The portion facing the opening 2*a* forms the wall 5. In addition, as shown in FIGS. 4A and 4B, the card 1 has a contact 3 used for signal processing. The front end of the contact 3 is exposed in the recess 2.

[The Structure of the Relevant Part of the First Embodiment]

As shown in FIG. 1, the first embodiment of the present invention includes a housing 6 forming a main body. The inside of the housing 6 accommodates the card 1. As shown in FIGS. 4A and 4B, the housing 6 has the header 7 in the back of the card connector. As shown in FIGS. 4A and 4B, the header 7 has a terminal 8 coming into contact with the contact 3 of the card 1. The header 7 has a groove 9, and part of the terminal 8 is exposed in the groove 9. The upper wall 7*a* covering the groove 9 of the header 7 can be inserted into the recess 2 of the card 1. In addition, as shown in FIG. 4B, the lower wall 4*b* and part of the contact 3 forming the lower portion of the recess 2 of the card 1 can be inserted into the groove 9 of the header 7.

A journal 11 is formed on the header 7. The journal 11 is integrated with the header 7. The ejecting lever 10 is disposed on the header 7. The ejecting lever 10 is supported by the journal 11 as the fulcrum and pushes out the card 1 in the direction of ejecting the card 1. That is to say, the journal 11 functioning as the fulcrum of the ejecting lever 10 is fixed on the header 7.

As shown in FIG. 1, a push rod 13 is connected to a first end 12 of the ejecting lever 10. The end of the push rod 13 is provided with a knob 14 for pushing the push rod 13.

As shown in FIG. 1, a second end 15 of the ejecting lever 10 is provided with a first pushing portion 16 pushing the wall 5 of the recess 2 of the card 1 in the starting stage of card ejection. In addition, there is formed a second pushing portion 17 which is farther than the first pushing portion 16 from the journal 11 and pushes the wall 5 of the recess 2 of the card 1 after the starting stage of card ejection.

The first pushing portion 16 and the second pushing portion 17 are included in distance varying means increasing the distance from the journal 11 to the contact point between the ejecting lever 10 and the card 1 during ejection of the card 1. The journal 11 functions as the fulcrum. In the starting stage of card ejection of the first embodiment, as shown in FIG. 1, the distance from the journal 11 to the first pushing portion 16, that is to say, the contact point between the ejecting lever 10 and the card 1 is a comparatively small distance L1. After that, as shown in FIG. 3, the distance from the journal 11 to the second pushing portion 17, that is to say, the contact point between the ejecting lever 10 and the card 1 is a greater distance L2 than the above distance L1.

[Placing of the Card]

The card 1 inserted into the housing 6 as shown in FIG. 4A is pushed to be in place as shown in FIG. 4B. When the card 1 is in place, the recess 2 of the card 1 accommodates the upper wall 7*a* and at least part of the ejecting lever 10, and the first pushing portion 16 of the ejecting lever 10 is in contact with the wall 5 of the recess 2 of the card 1. In addition, the groove 9 of the header 7 accommodates the lower wall 4*b* of the card 1 and part of the contact 3. Thus, the contact 3 of the card 1 and the terminal 8 of the header 7 come into contact, thereby enabling the signal transmitting and receiving between the card 1 and the header 7.

[Ejection of the Card]

FIG. 1 corresponds to FIG. 4B. In order to eject the card 1 in place as shown in FIG. 1 and FIG. 4B, the knob 14 shown in FIG. 1 is pushed. Thus, the push rod 13 is pushed in the direction of inserting the card 1, and the first end 12 of the ejecting lever 10 moves in the direction of inserting the card 1. Thus, the ejecting lever 10 starts turning around the journal 11 counterclockwise in FIG. 1. At this moment, the pushing force of the first pushing portion 16 of the ejecting lever 10 on the card 1 is a comparatively great pushing force F1 as indicated by the following formula.

$$F1 \cdot L1 = F \cdot L$$

The ejected distance of the card 1 in the starting stage of ejection is a comparatively small distance S1 according to the comparatively small distance L1.

As described above, in the starting stage of card ejection, the comparatively great pushing force F1 is obtained. Therefore, the ejecting lever 10 can push out the card 1 in the ejecting direction, overcoming a comparatively great connecting force between the contact 3 of the card 1 and the terminal 8 of the header 7.

By further turning of the ejecting lever 10, as shown in FIG. 2, the second pushing portion 17 of the ejecting lever 10 also comes into contact with the wall 5 of the recess 2 of the card 1.

By more further turning of the ejecting lever 10, the first pushing portion 16 goes out of contact with the card 1. After that, only the second pushing portion 17 is in contact with the card 1 as shown in FIG. 3. At this moment, the ejected distance of the card 1 by the second pushing portion 17 is a great distance S2 according to the greater distance L2 than the distance L1.

At this moment, the pushing force of the second pushing portion 17 on the card 1 is a comparatively small pushing force F2 as indicated by the following formula.

$$F2 \cdot L2 = F \cdot L$$

Although the pushing force on the card 1 is the comparatively small force F2, the card 1 is ejected smoothly because the card 1 is no longer under the connecting force between the contact 3 of the card 1 and the terminal 8 of the header 7.

Figure 5:
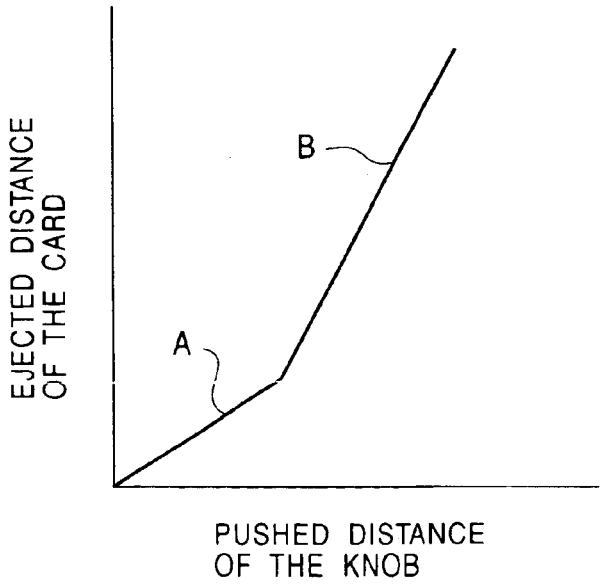
FIG. 5 is a characteristics diagram showing the relation between pushed distance of the knob and ejected distance of the card in the first embodiment of the present invention.

FIG. 5 is a characteristics diagram showing the relation between pushed distance of the knob and ejected distance of the card in the first embodiment.

In FIG. 5, the line segment A shows the characteristics when the first pushing portion 16 of the ejecting lever 10 pushes the card 1, and the line segment B shows the characteristics when the second pushing portion 17 pushes the card 1.

In the starting stage of card ejection, the distance from the journal 11 of the ejecting lever 10 to the first pushing portion 16 of the ejecting lever 10 in contact with the card 1 is comparatively small. Therefore, by turning the ejecting lever 10, it is possible to apply a comparatively great force F1 to the card 1 so as to push out the card 1. After that, the second pushing portion 17 comes into contact with the card 1, thereby increasing the distance from the journal 11 of the ejecting lever 10 to the contact point between the ejecting lever 10 and the card 1. Therefore, the ejected distance S2 of the card 1 ejected with the turning of the ejecting lever 10 becomes great so that the card 1 can be ejected quickly.

More particularly, the position of the journal 11 functioning as the fulcrum of the ejecting lever 10 is fixed. Therefore, the ejecting lever 10 turns around only a single fulcrum during ejection of the card 1. Thus, the stability of turning of the ejecting lever 10 is achieved, and the reliability of the card connector is increased.

In the first embodiment, the ejecting lever 10 is disposed in the back of the connector. There is the header 7 in which the terminal 8 is provided. It is possible to make use of the header 7 for disposing the ejecting lever 10, thereby achieving a compact structure.

In the first embodiment, since the journal 11 of the ejecting lever 10 is integrated with a header 7, the journal 11 can be formed at the same time as the header 7. Therefore, because of the small number of parts, the production cost can be reduced.

In the first embodiment, since the first pushing portion 16 and the second pushing portion 17 is integrated with the ejecting lever 10, the first pushing portion 16 and the second pushing portion 17 can be formed at the same time as the ejecting lever 10. Therefore, because of the small number of parts, the production cost can be reduced.

The card 1 has the recess 2 accommodating at least part of the ejecting lever 10. Therefore, the card connector can be downsized with respect to the depth.

In the first embodiment, the card 1 has the upper wall 4 covering the recess 2. Since the upper wall 4 restricts the vertical movement of the ejecting lever 10, smooth turning of the ejecting lever 10 is achieved. Thus, the turning performance of the ejecting lever 10 is increased. In addition, since the ejecting lever 10 is not located on the upper surface of the card 1, the upper surface of the card 1 is protected from being scraped by the ejecting lever 10. Thus, the reliability of the card connector is increased.

In addition, since the first embodiment includes the push rod 13 turning the ejecting lever 10, and the knob 14, the card 1 can be easily ejected by pushing the knob 14.

Figure 6:
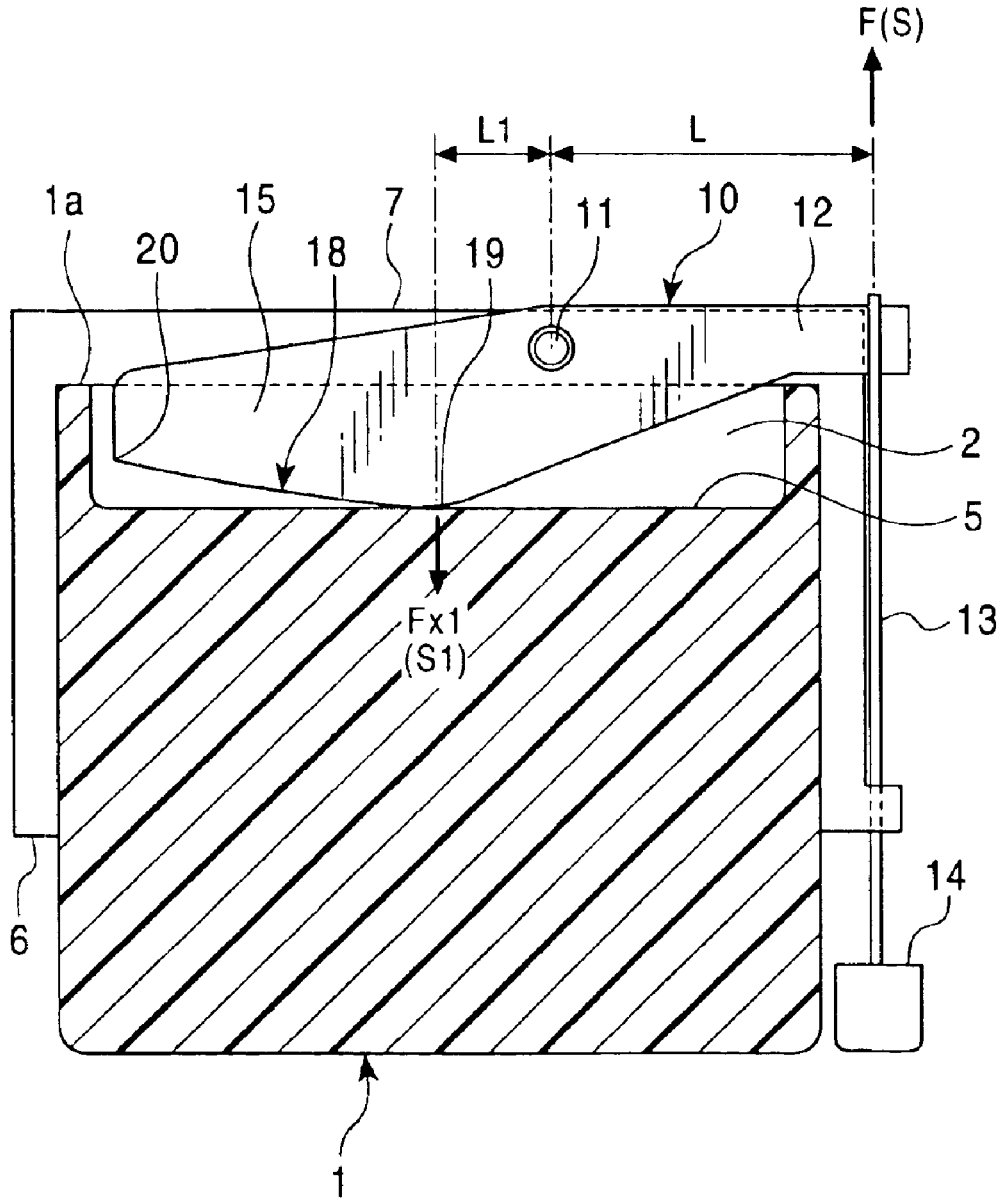
FIG. 6 is a plan view showing a card connector in the starting stage of card ejection according to a second embodiment of the present invention, including a sectional view of the card.
Figure 7:
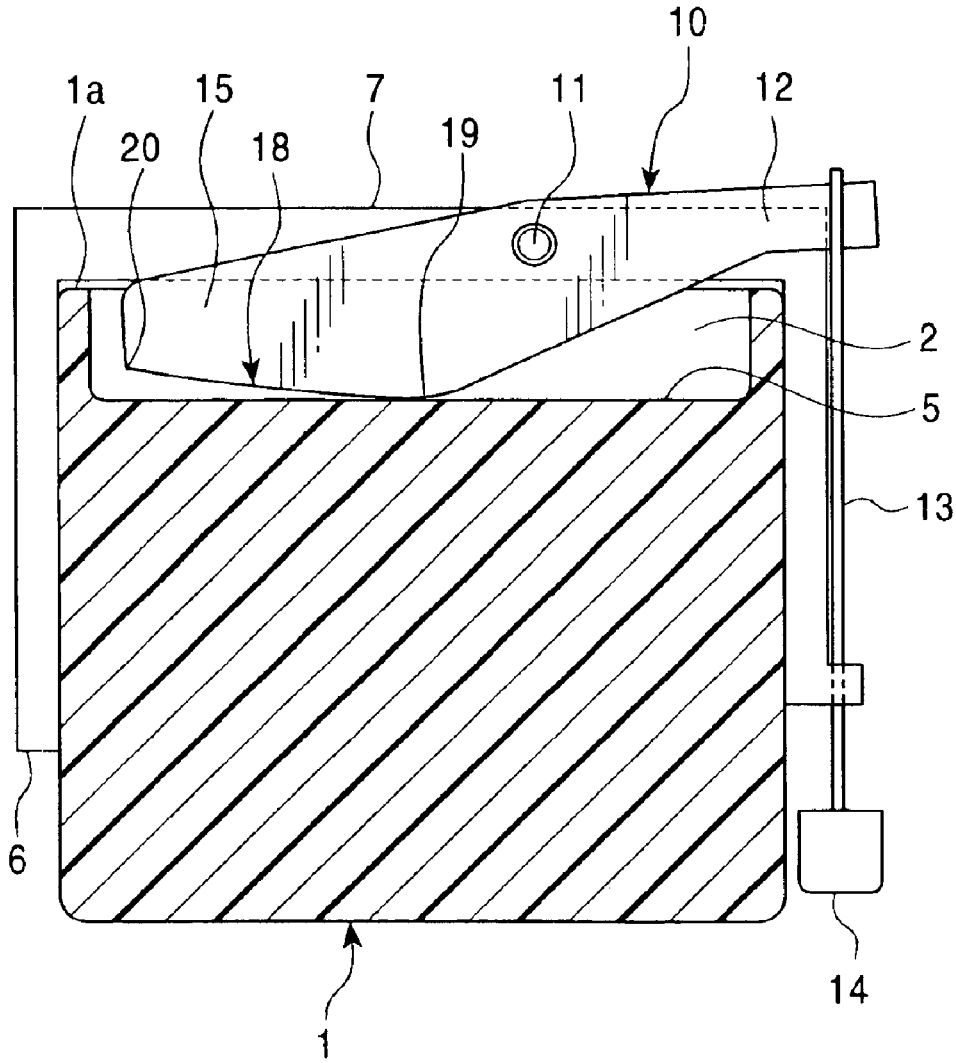
FIG. 7 is a plan view showing the card connector in the middle stage of card ejection according to the second embodiment of the present invention, including a sectional view of the card.
Figure 8:
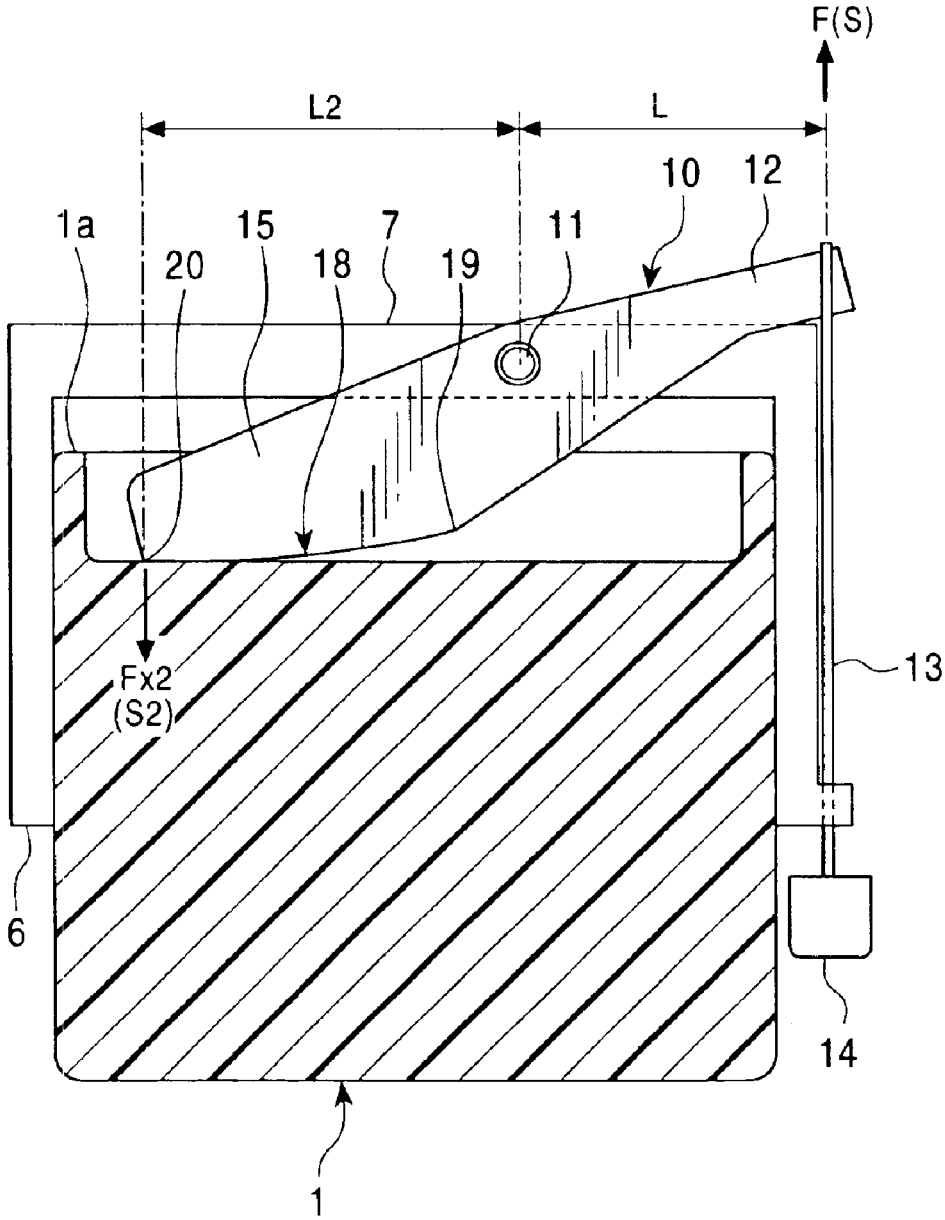
FIG. 8 is a plan view showing the card connector in the ending stage of card ejection according to the second embodiment of the present invention, including a sectional view of the card.

FIGS. 6 to 8 are illustrations of a second embodiment of the present invention, including sectional views of a card. FIG. 6 is a plan view showing the starting stage of card ejection. FIG. 7 is a plan view showing the middle stage of card ejection. FIG. 8 is a plan view showing the ending stage of card ejection.

[The Structure of the Relevant Part of the Second Embodiment]

The second embodiment has different distance varying means from the first embodiment.

That is to say, in the second embodiment, as shown in FIG. 6, the distance varying means include a curved portion 18 disposed at the second end 15 of the ejecting lever 10, the curved portion 18 pushing the card 1. The curved portion 18 includes a contact-starting segment 19 and a contact-ending segment 20. The line connecting the contact-starting segment 19 and the contact-ending segment 20 is convex toward the front end 1*a* of the card 1.

The other structure is the same as in the first embodiment.

[Ejection of the Card]

Also in the second embodiment, in order to eject the card 1 in place, the knob 14 shown in FIG. 6 is pushed. Thus, the push rod 13 moves, and the ejecting lever 10 connected to the push rod 13 starts turning counterclockwise in FIG. 6 around the journal 11 functioning as the fulcrum. At this moment, the pushing force of the contact-starting segment 19 of the curved portion 18 on the card 1 is a comparatively great pushing force F×1 as indicated by the following formula.

$$Fx1 \cdot L1 = F \cdot L$$

The ejected distance of the card 1 in the starting stage of ejection is a comparatively small distance S1 according to the comparatively small distance L1.

As described above, in the starting stage of card ejection, the comparatively great pushing force F×1 is obtained. Therefore, the ejecting lever 10 can push out the card 1 in the ejecting direction, overcoming the comparatively great connecting force between the contact 3 of the card 1 and the terminal 8 of the header 7.

As shown in FIG. 7, according to the convexity of the curved portion 18, the contact point between the curved portion 18 and the card 1 is displaced away from the journal 11 functioning as the fulcrum continuously with further turning of the ejecting lever 10. That is to say, the contact point moves with turning of the ejecting lever 10 along the wall 5 of the recess 2 forming the front end 1*a* of the card 1. Thus, in the ejection starting stage, the distance from the journal 11 to the nearer segment of the curved portion 18, that is to say, the contact-starting segment 19 is small. After that, the distance from the journal 11 to the contact point between the curved portion 18 and the card 1, that is to say, the farther segment increases gradually.

The ejected distance of the card 1 in the ending stage of card ejection shown in FIG. 8 by the contact-ending segment 20 of the curved portion 18 is a great distance S2 according to the distance L2 greater than the distance L1.

At this moment, the pushing force of the contact-ending segment 20 on the card 1 is a comparatively small pushing force F×2 as indicated by the following formula.

$$F \times 2 \cdot L2 = F \cdot L$$

Although the pushing force on the card 1 is the comparatively small force F×2, the card 1 is ejected smoothly because the card 1 is no longer under the connecting force between the contact 3 and the terminal 8 of the header 7.

Figure 9:
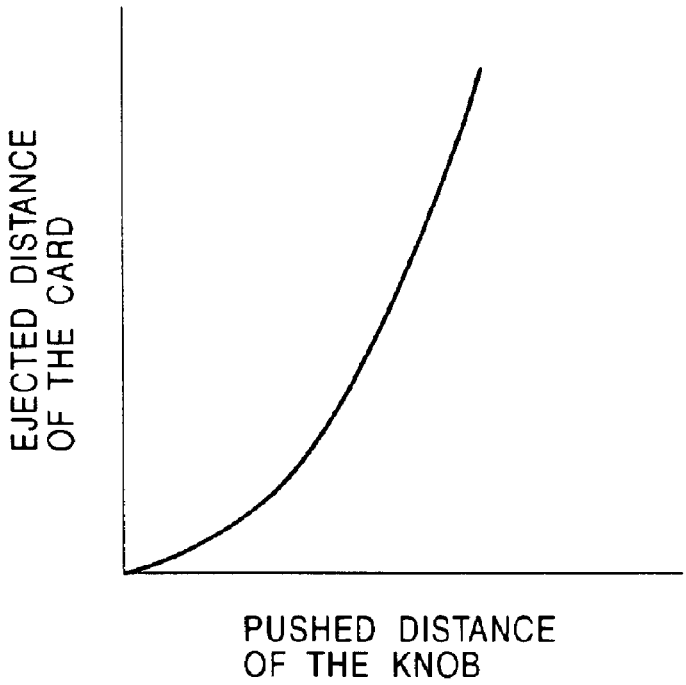
FIG. 9 is a characteristics diagram showing the relation between pushed distance of the knob and ejected distance of the card in the second embodiment of the present invention.

FIG. 9 is a characteristics diagram showing the relation between pushed distance of the knob and ejected distance of the card in the second embodiment.

As shown in FIG. 9, in the second embodiment, it is possible to increase the ejected distance of the card 1 nonlinearly in relation to the pushed distance of the knob 14.

In the second embodiment, in the starting stage of card ejection, it is possible to apply a comparatively great force F×11 to the card 1 via the nearer segment of the curved portion 18, that is to say, the contact-starting segment 19 so as to push out the card 1. After that, it is possible to increase the ejected distance of the card 1 continuously as shown in FIG. 9 via the farther segment of the curved portion 18, that is to say, the contact point so as to push out the card 1 quickly. The position of the journal 11 of the ejecting lever 10 is fixed as in the first embodiment.

Therefore, the second embodiment also achieves the same advantageous effect as the first embodiment. Especially, in the ejection of the card 1, since the ejected distance of the card 1 is increased continuously with turning of the ejecting lever 10, the card 1 is ejected smoothly, and excellent card-ejection performance is achieved.

Figure 10:
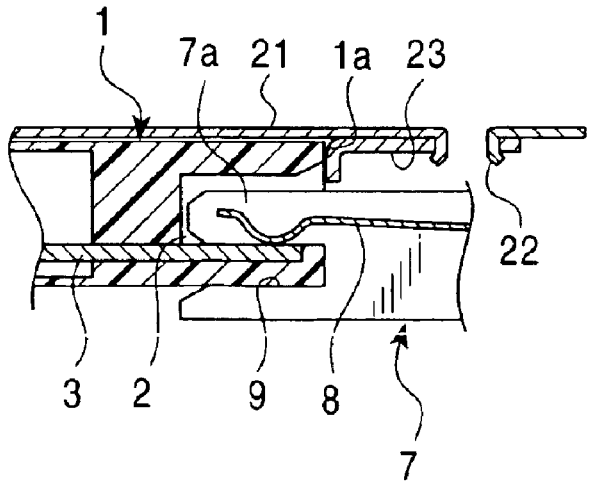
FIG. 10 is a cross-sectional view showing the relevant part of a third embodiment of the present invention.

FIG. 10 is a cross-sectional view showing the relevant part of a third embodiment of the present invention. As shown in FIG. 10, in the third embodiment, a journal 22 functioning as the fulcrum of an ejecting lever 23 is integrated with the cover 21 covering the housing 6 forming the main body. In addition, the ejecting lever 23 is disposed so as to be in contact with the front end 1*a* of the card 1. Unlike the first and second embodiments, the recess 2 of the card 1 accommodates only the upper wall 7*a* including the terminal 8 of the header 7. The other structure is the same as in the first embodiment.

Since the second end 15 of the ejecting lever 23 pushes the front end 1*a* of the card 1 with turning of the ejecting lever 23, and the position of the journal 22 formed in the cover 21 is fixed, the third embodiment also achieves the same advantageous effect as the first embodiment.

Since the journal 22 of the ejecting lever 23 is integrated with the cover 21, the journal 22 can be formed at the same time as the cover 21. Therefore, because of the small number of parts, the production cost can be reduced.

What is claimed is:

1. A card connector comprising: a rotatable ejecting lever having a first end and a second end and journaled at a fixed fulcrum, the second end moving in the direction of ejecting a card to push out the card when the first end is pushed in the direction of inserting the card, and the fulcrum being disposed between the widthwise center of the card and one of the first and second ends; and distance varying means increasing the distance from the fulcrum to the contact point between the ejecting lever and the card during ejection of the card, wherein the contact point is placed at almost the widthwise center of the card in an ejection staring stage, and is placed at the other end remote from the fulcrum in an ejection ending stage.

2. The card connector according to claim 1, wherein the ejecting lever is disposed in the back of the connector.

3. The card connector according to claim 2, wherein the fulcrum is a journal integrated with a header having a terminal coming into contact with a contact of the card used for signal processing.

4. The card connector according to claim 2, wherein the fulcrum is a journal integrated with a cover covering a housing forming a main body.

5. The card connector according to claim 2, wherein the distance varying means include a first pushing portion and a second pushing portion disposed at the second end of the ejecting lever, the first pushing portion pushing the card in the starting stage of card ejection, the second pushing portion being farther than the first pushing portion from the fulcrum and pushing the card after the starting stage of card ejection.

6. The card connector according to claim 2, wherein the distance varying means include a curved portion disposed at the second end of the ejecting lever, the curved portion pushing the card and being convex toward the front end of the card, the front end of the card being in the back of the connector when the card is in place.

7. The card connector according to claim 2, wherein the ejecting lever is disposed such that the second end of the ejecting lever pushes the front end of the card when the card is ejected, the card being in the back of the connector when the card is in place.

8. The card connector according to claim 2, further comprising a push rod pushing the first end of the ejecting lever in the direction of inserting the card.

9. A card connector comprising:

a rotatable ejecting lever having a first end and a second end and journaled at a fixed fulcrum, the second end moving in the direction of ejecting a card to push out the card when the first end is pushed in the direction of inserting the card; and distance varying means increasing the distance from the fulcrum to the contact point between the ejecting lever and the card during ejection of the card, wherein the ejecting lever is disposed in the back of the connector, wherein the fulcrum is a journal integrated with a header having a terminal coming into contact with a contact of the card used for signal processing, and wherein the card has a recess accommodating at least part of the second end of the ejecting lever, the recess being at the front end of the card in the back of the connector when the card is in place, and the ejecting lever is disposed so that the second end pushes the wall of the recess when the card is ejected.

10. The card connector according to claim 9, wherein the card has an upper wall covering the recess.

* * * * *